United States Patent [19]

Robertson

[11] Patent Number: 4,611,780

[45] Date of Patent: Sep. 16, 1986

[54] PICTURE HANGING ASSEMBLY

[76] Inventor: Larry M. Robertson, 1142 Mapleleaf Dr., Rochester, Mich. 48063

[21] Appl. No.: 744,032

[22] Filed: Jun. 12, 1985

[51] Int. Cl.[4] ..... A47G 1/24

[52] U.S. Cl. ..... 248/477; 40/152.1; 248/496

[58] Field of Search ..... 248/477, 476, 496, 495, 248/454; 40/152.1; D8/373

[56] References Cited

U.S. PATENT DOCUMENTS

| | | | |
|---|---|---|---|
| D. 238,142 | 12/1975 | Wiener, Jr. . | |
| D. 257,219 | 10/1980 | Cook . | |
| D. 262,687 | 1/1982 | Collet . | |
| D. 266,223 | 9/1982 | Swartz . | |
| 3,165,287 | 1/1965 | Parsons | 248/496 X |
| 3,169,738 | 2/1965 | Johnson | 248/496 |
| 3,529,799 | 9/1970 | Schaefer | 248/496 |
| 4,069,998 | 1/1978 | Rytting | 248/476 |
| 4,171,117 | 10/1979 | Prochaska | 248/495 |
| 4,368,867 | 1/1983 | Pendleton et al. | 248/1 I |
| 4,496,128 | 1/1985 | Larsen | 248/496 |

FOREIGN PATENT DOCUMENTS

| | | | |
|---|---|---|---|
| 602060 | 7/1978 | Switzerland | 248/495 |
| 21311 | of 1906 | United Kingdom | 248/496 |

*Primary Examiner*—J. Franklin Foss
*Assistant Examiner*—David L. Talbott
*Attorney, Agent, or Firm*—Gifford, Groh, VanOphem, Sheridan, Sprinkle & Dolgorukov

[57] ABSTRACT

A picture hanging assembly is disclosed for attaching a picture to a wall structure. The assembly includes a first bracket having an elongated body and two prongs which extend outwardly from one edge of the body and in which the prongs are longitudinally spaced from each other. A second bracket also has an elongated body and two recesses which are open to one edge of the body and are dimensioned to slidably receive the prongs. The bottoms of the recesses are inclined in opposite directions with respect to the axis of the second bracket body. One bracket is secured to the picture while the other bracket is secured to a wall structure.

5 Claims, 4 Drawing Figures

PICTURE HANGING ASSEMBLY

BACKGROUND OF THE INVENTION

I. Field of the Invention

The present invention relates to a picture hanging assembly and, more particularly, to such an assembly with a levelling adjustment.

II. Description of the Prior Art

The previously known method of hanging pictures and like objects to walls typically comprises attaching a picture hook to the wall which engages a string or wire attached to the back of the picture. There are, however, a number of disadvantages in this previously known method for attaching pictures to walls.

One disadvantage of this previous picture hanging method is that the picture sways when subjected to vibration or sudden jarring. When this happens, the picture hook frequently slides to one side of the wire on the picture so that the picture hangs from the wall at an oblique angle.

One previously known method of minimizing this problem is to attach two or more picture hangers to the wall so that both hangers engage the wire attached to the back of the picture at horizontally spaced position. One disadvantage of this method, however is that it is very difficult to attach the picture hangers to the wall so that the picture hangs level.

SUMMARY OF THE PRESENT INVENTION

The present invention provides a picture hanger assembly which overcomes all of the above mentioned disadvantages of the previously known devices.

In brief, the picture hanger assembly of the present invention comprises a first bracket having an elongated body and with two prongs which extend outwardly from one edge of the body and so that the prongs are longitudinally spaced from each other. This first bracket is then attached to the back of a picture substantially at its top center so that the prongs extend downwardly.

A second bracket also includes an elongated body but, unlike the first bracket, has two recesses which are open to one edge of the second bracket. Each recess, furthermore, has a bottom spaced from and facing its open edge and the bottom of these recesses are inclined or sloped with respect to the longitudinal axis of the second bracket. Furthermore, these recesses are dimensioned to slidably receive the prongs therein and each recess slopes in the opposite direction. This second bracket is attached to the wall by conventional fasteners so that the recess openings face upwardly.

With the first bracket attached to the picture and the second bracket attached to the wall as described above, the prongs are slid into the recesses on the second bracket thereby attaching the picture to the wall in the desired fashion. Furthermore, since the bottom of the recesses slope in opposite directions from each other, the picture can be easily levelled by shifting the prongs along the bottom of the recesses until the picture is level. In addition, the bottom of each recess is preferably stepped to firmly engage and support the prongs against any movement from vibration or jarring.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
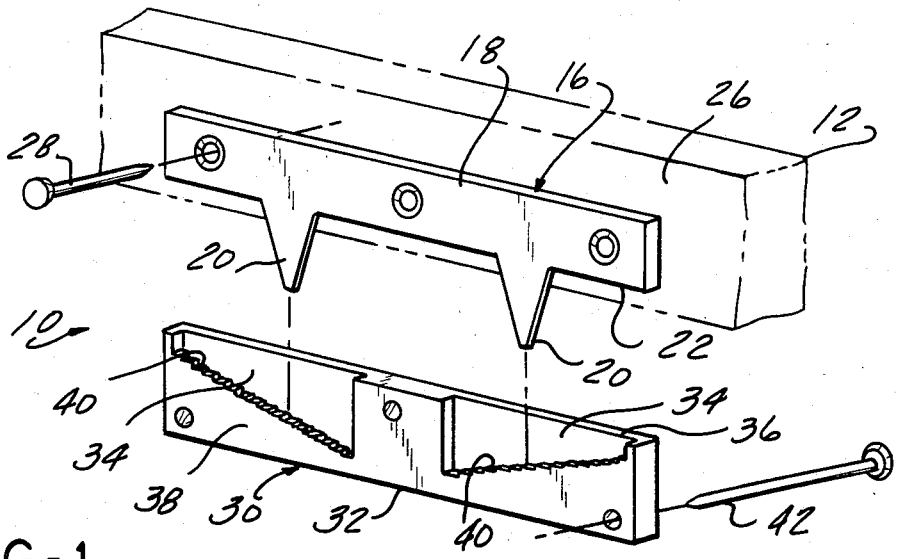
FIG. 1 is an exploded perspective view illustrating a preferred embodiment of the present invention.
Figure 3:
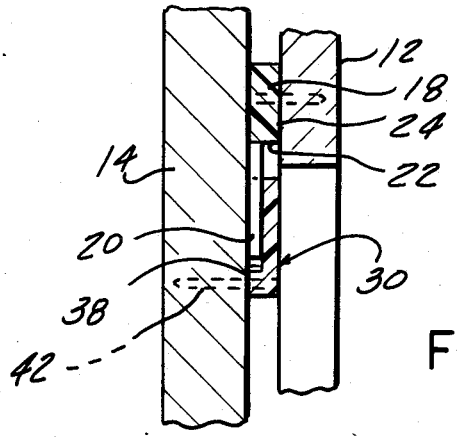
FIG. 3 is a fragmentary sectional view taken along lines 3—3 in FIG. 2.

With reference first to FIG. 1, a preferred embodiment of the picture hanger assembly 10 of the present invention is thereshown for mounting a picture 12 to a wall structure or wall 14 (FIG. 3). Furthermore, as used in this specification, the term "picture" will be broadly construed to include prints, paintings, photographs, wall hangings, and the like. Similarly, the term "wall" or "wall structure" shall also be broadly construed to mean a wall, door as well as any other vertically extending structure on which the picture 12 is mounted.

With reference still to FIG. 1 the picture hanger assembly 10 comprises a first bracket 16 having an elongated and generally flat body portion 18 and two generally triangular prongs 20 which extend downwardly from a lower edge 22 of the body portion 18. As best shown in FIGS. 1 and 3, these prongs 20 are longitudinally spaced from each other and are also spaced from one side 24 of the body portion 18.

The first bracket 16 is attached to the back 26 of the picture 12 so that the body portion 18 extends substantially horizontally and is positioned adjacent the top center of the picture back 26. Any conventional fasteners, such as nails 28, are used to secure the first bracket 16 to the picture 12.

Still referring to FIG. 1, the picture hanger assembly 10 further comprises a second bracket 30 which, like the first bracket 16, includes an elongated body 32 which is substantially flat. A pair of recesses 34 are formed in the second bracket body 32 so that the recesses 34 are opened to an upper edge 36 of the bracket body 32 as well as one side 38 of the bracket body 32.

Figure 4:
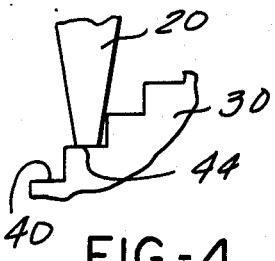
FIG. 4 is an enlarged view showing in detail the engagement feature of the preferred, stepped embodiment.

Each recess 34 includes a bottom 40 which is inclined with respect to the longitudinal axis of the body 32. More specifically, the bottoms 40 of the recesses 34 slope upwardly in opposite directions from a position adjacent the bottom center of the body 32 and toward the upper edge 36 of the body 32. In addition, as best shown in FIG. 4, the bottom 40 of each recess 34 is preferably stepped.

As best shown in FIG. 3, the second bracket 30 is secured to the wall 14 by any conventional means, such as fasteners 42, so that the side 38 of the body 32 flatly abuts against the wall 14. Consequently, with the second bracket 30 secured to the wall 14 in this fashion, the wall 14 covers one side of each recess 34 so that each recess 34 is opened only at the upper edge 36 of the bracket body 32.

With the first bracket 16 secured to the picture 12 and the second bracket 30 secured to the wall 14 as previously described, the prongs 20 on the first bracket 16 extend downwardly while the recesses 34 are open upwardly. Furthermore, the brackets 16 and 30 are dimensioned so that the prongs 20 are slidably received within the recesses 34 to the position shown in FIGS. 2 and 3, in which a lower flattened end 44 (FIG. 4) of each prong 20 engages a step in the bottom 40 of the recesses 34 whereupon the second bracket 30 supports the first bracket 16 with its attached picture 12 on the wall 14.

Figure 2:
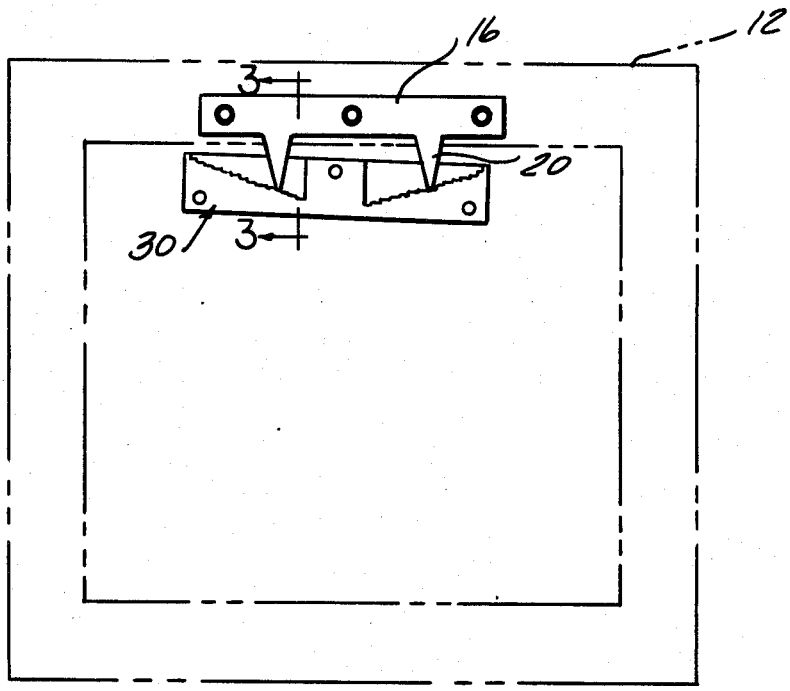
FIG. 2 is a back view of the preferred embodiment.

With reference to FIG. 2, in the event that the picture 12 is crooked, the picture 12 can be rapidly levelled by merely shifting the picture 12 until the prongs 20 engage different steps in the bottoms 40 of the recesses 34 until the picture is level. Such initial unevenness can result, for example, if either of the brackets 16 or 30 are secured to either the picture 12 or wall 14, respectively, at an oblique angle.

From the foregoing, it can be seen that the picture hanger assembly of the present invention provides a simple, inexpensive and yet totally effective means for hanging a picture on a wall. Furthermore, since the prongs 20 engage the stepped and inclined bottoms 40 of the recesses 34, the picture 12 is firmly and securely fastened to the wall 14 against vibration and jarring. In addition, accurate levelling of the picture 12 can be readily accomplished by merely adjusting the position of the prongs 20 within their respective receses 34 until the picture 12 is level.

Although in the preferred embodiment of the invention, the first bracket 16 is secured to the picture 12 and the second bracket 30 is secured to the wall 14, it will be understood that this can be reversed, i.e. the first bracket 16 can be secured to the wall 14 and the second bracket 30 secured to the picture 12. In this event, however, it will be necessary to invert both brackets 16 and 30 so that the prongs 20 protrude upwardly while the recesses 34 open downwardly.

Furthermore, in the preferred embodiment of the invention, each bracket 16 and 30 is of a one piece plastic construction for inexpensive manufacturing.

Having described my invention, however, many modifications thereto will become apparent to those skilled in the art to which it pertains without deviation from the spirit of the invention as defined by the scope of the appended claims.

I claim:

1. A picture hanging assembly comprising a first bracket having an elongated body and two prongs which extend outwardly from one edge of said body, said prongs being longitudinally spaced from each other and having a free end, a second bracket having an elongated body and two recesses open to one edge of said second bracket body, each recess being dimensioned to slidably receive one prong, each recess having a bottom spaced from and facing said one edge of said second bracket body, said bottoms of said recesses being inclined with respect to the longitudinal axis of said second bracket body and so that said bottoms are inclined in opposite angular directions, means for attaching one of said brackets to a picture, and means for attaching the other of said brackets to a wall structure wherein each prong has a length so that, with each prong positioned within its receiving recess and having its free end in abutment with the bottom of its receiving recess, said body of said first bracket is spaced from said body of said second bracket.

2. The invention as defined in claim 1 wherein each bottom comprises a stepped surface.

3. The invention as defined in claim 2 and comprising a flat formed on the free end of each prong.

4. The invention as defined in claim 1 wherein said bottom slopes upwardly from a point adjacent a bottom center of said second bracket body towards opposite ends of said second bracket body.

5. The invention as defined in claim 1 wherein each recess is open to one side of said second bracket body, wherein said second bracket securing means comprises means for securing said second bracket to one of said picture or said wall structure so that said one side of said second bracket body flatly abuts against said picture or said wall structure, and wherein said prongs are spaced outwardly from one side of said first bracket body.

* * * * *